US010193262B2

(12) United States Patent
Henry

(10) Patent No.: US 10,193,262 B2
(45) Date of Patent: Jan. 29, 2019

(54) ELECTRICAL DEVICE HAVING AN INSULATOR WAFER

(71) Applicant: TE CONNECTIVITY CORPORATION, Berwyn, PA (US)

(72) Inventor: Randall Robert Henry, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 2 days.

(21) Appl. No.: 15/601,555

(22) Filed: May 22, 2017

(65) Prior Publication Data

US 2018/0337483 A1 Nov. 22, 2018

(51) Int. Cl.

| | |
|---|---|
| ***H01R 13/40*** | (2006.01) |
| ***H01R 13/6588*** | (2011.01) |
| ***H01R 13/6471*** | (2011.01) |
| ***H01R 12/71*** | (2011.01) |

(52) U.S. Cl.

CPC ..... *H01R 13/40* (2013.01); *H01R 12/714* (2013.01); *H01R 13/6471* (2013.01); *H01R 13/6588* (2013.01)

(58) Field of Classification Search

CPC ..... H01R 13/40; H01R 13/648
USPC ..... 439/386
See application file for complete search history.

(56) References Cited

U.S. PATENT DOCUMENTS

| | | | | |
|---|---|---|---|---|
| 9,741,465 | B2 * | 8/2017 | Gross | H01B 7/00 |
| 2004/0002262 | A1 * | 1/2004 | Murayama | H01R 4/023 439/607.1 |
| 2010/0210138 | A1 * | 8/2010 | Kuwahara | H01R 9/034 439/607.01 |
| 2013/0244482 | A1 * | 9/2013 | Kondo | H01R 9/034 439/578 |
| 2014/0170897 | A1 * | 6/2014 | Nonen | H01R 13/5829 439/467 |
| 2016/0134040 | A1 * | 5/2016 | Phillips | H01R 12/721 439/374 |
| 2016/0218455 | A1 * | 7/2016 | Sayre | H01R 13/6594 |
| 2017/0279219 | A1 * | 9/2017 | Humbert | H01R 13/5808 |

* cited by examiner

*Primary Examiner* — Abdullah Riyami
*Assistant Examiner* — Nader Alhawamdeh

(57) ABSTRACT

An electrical device includes a substrate having a signal contact and a ground contact along a surface of the substrate. The electrical device also includes an insulator wafer having a front surface, a rear surface, and an opening, the front surface facing the signal contact. A communication cable includes a signal conductor, an insulator surrounding the signal conductor, and a shield layer that surrounds the insulator. The insulator and the shield layer have substantially coplanar terminating ends, and a terminating end of the signal conductor extends beyond a terminating end of the insulator. The signal conductor has a terminating end that projects through the opening of the insulator wafer to electrically couple with the signal contact. The insulator wafer electrically blocks the shield layer from the signal conductor and the signal contact.

19 Claims, 6 Drawing Sheets

ELECTRICAL DEVICE HAVING AN INSULATOR WAFER

BACKGROUND OF THE INVENTION

The subject matter herein relates generally to an electrical device having an insulator for providing electrical isolation.

Communication cables electrically couple to various types of electrical devices to transmit differential signals, such as connectors and circuit boards. At least some known communication cables include a differential pair of signal conductors surrounded by a shield layer that, in turn, is surrounded by a cable jacket. The shield layer includes a conductive foil, which functions to shield the signal conductor(s) from electromagnetic interference (EMI) and generally improve performance. At an end of the communication cable, the cable jacket, the shield layer, and insulation that covers the signal conductor(s) may be removed (e.g., stripped) to expose the signal conductor(s). The exposed portions of the conductor(s) may then be mechanically and electrically coupled (e.g., soldered) to corresponding elements of an electrical device. However, the lack of shielding in the exposed portions may cause a high impedance mismatch and reduce the overall performance of the device. In addition, stripping of the communication cable may expose portions of the shield layer that may contact the signal conductor or elements of the substrate and cause a short in the electrical device.

Accordingly, there is a need for an electrical device that includes an insulator that provides electrical isolation.

BRIEF DESCRIPTION OF THE INVENTION

In one embodiment, an electrical device is provided that includes a substrate having a signal contact and a ground contact along a surface of the substrate. The electrical device includes an insulator wafer having a front surface, a rear surface, and an opening, with the front surface facing the signal contact. The electrical device also includes a communication cable having a signal conductor, an insulator surrounding the signal conductor, and a shield layer that surrounds the insulator. The insulator has a terminating end and the shield layer has a terminating end substantially coplanar with the terminating end of the insulator. A terminating end of the signal conductor extends beyond the terminating end of the insulator, and projects through the opening of the insulator wafer to electrically couple with the signal contact. The insulator wafer electrically isolates the shield layer from the signal conductor and the signal contact.

In another embodiment, an electrical device is provided that includes a substrate having an upper signal contact and an upper ground contact along an upper surface of the substrate. The electrical device includes an upper insulating wafer having a front surface, a rear surface, and an opening, with the front surface facing the upper signal contact. The electrical device also includes an upper communication cable having a signal conductor, an insulator surrounding the signal conductor, and a shield layer that surrounds the insulator. The insulator and the shield layer have substantially coplanar terminating ends, and a terminating end of the signal conductor extends beyond a terminating end of the insulator. The terminating end of the signal conductor projects through the opening of the upper insulating wafer to electrically couple with the upper signal contact. The upper insulating wafer electrically isolates the shield layer from the signal conductor and the upper signal contact. The electrical device includes a lower insulating wafer having a front surface, a rear surface, and an opening, with the front surface facing the lower signal contact. The electrical device also includes a lower communication cable having a signal conductor, an insulator surrounding the signal conductor, and a shield layer that surrounds the insulator. The insulator and the shield layer have substantially coplanar terminating ends, and a terminating end of the signal conductor extends beyond a terminating end of the insulator. The terminating end of the signal conductor projects through the opening of the lower insulating wafer to electrically couple with the lower signal contact. The lower insulating wafer electrically isolates the shield layer from the signal conductor and the lower signal contact.

In yet another embodiment, an electrical device is provided that includes a substrate having signal contacts and ground contacts along a surface of the substrate. The electrical device also includes a plurality of communication cables, each communication cable having a signal conductor, an insulator surrounding the signal conductor, and a shield layer that surrounds the insulator. The insulator has a terminating end and the shield layer has a terminating end substantially coplanar with the terminating end of the insulator. A terminating end of the signal conductor extends beyond the terminating end of the insulator, and projects through the opening of the insulator wafer to electrically couple with the signal contact. The insulating wafer electrically isolates the shield layer from the signal conductor and the signal contact. The insulator wafer has a front surface, a rear surface, and a plurality of openings, and is interposed between the terminating ends of the communication cable and the signal contacts. The front surface of the insulator wafer faces the signal contact, and the rear surface of the insulating wafer faces the shield layers of the communication cables. The signal conductors project through the corresponding openings of the insulating wafer to electrically couple with the signal contacts.

DETAILED DESCRIPTION OF THE INVENTION

Embodiments described herein include electrical devices (e.g., electrical connectors, substrate assemblies, and the like) that have a substrate, electrical connectors, and communication cables, a ground bus bar, and an insulator wafer. For example, the communication cables may have one or more differential pairs of signal conductors electrically connected to the connectors and a drain wire coupled with the ground bus bar. The insulator wafer is interposed between the communication cables and the connectors to electrically isolate a shield layer of the communication cables from the signal conductors and the signal contacts of the connectors. The insulator wafer may have a variety of configurations as set forth herein.

Figure 1:
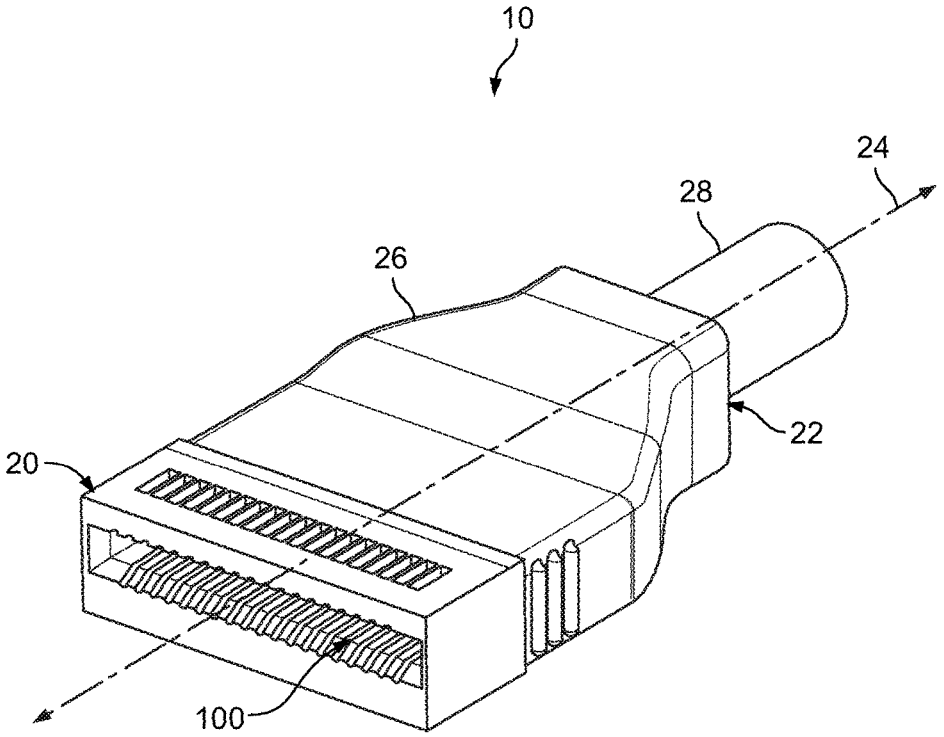
FIG. 1 is a perspective view of an electrical device according to one embodiment.

FIG. 1 is a perspective view of an electrical device 10 formed in accordance with one embodiment. In an exemplary embodiment, the electrical device 10 has a mating end 20, a cable end 22, and cable 28, and lies along a central axis 24. The electrical device 10 includes a device housing 26 configured to hold a portion of a connector or electrical assembly 100. In the illustrated embodiment, the electrical device 10 is a communication device, such as a serial attached SCSI (SAS) connector. However, the electrical device 10 may be another type of electrical connector in an alternative embodiment. For example, the electrical device 10 may define a socket or receptacle connector, such as a card edge socket connector configured to receive a circuit card therein, such as from a mating electrical connector.

Figure 2:
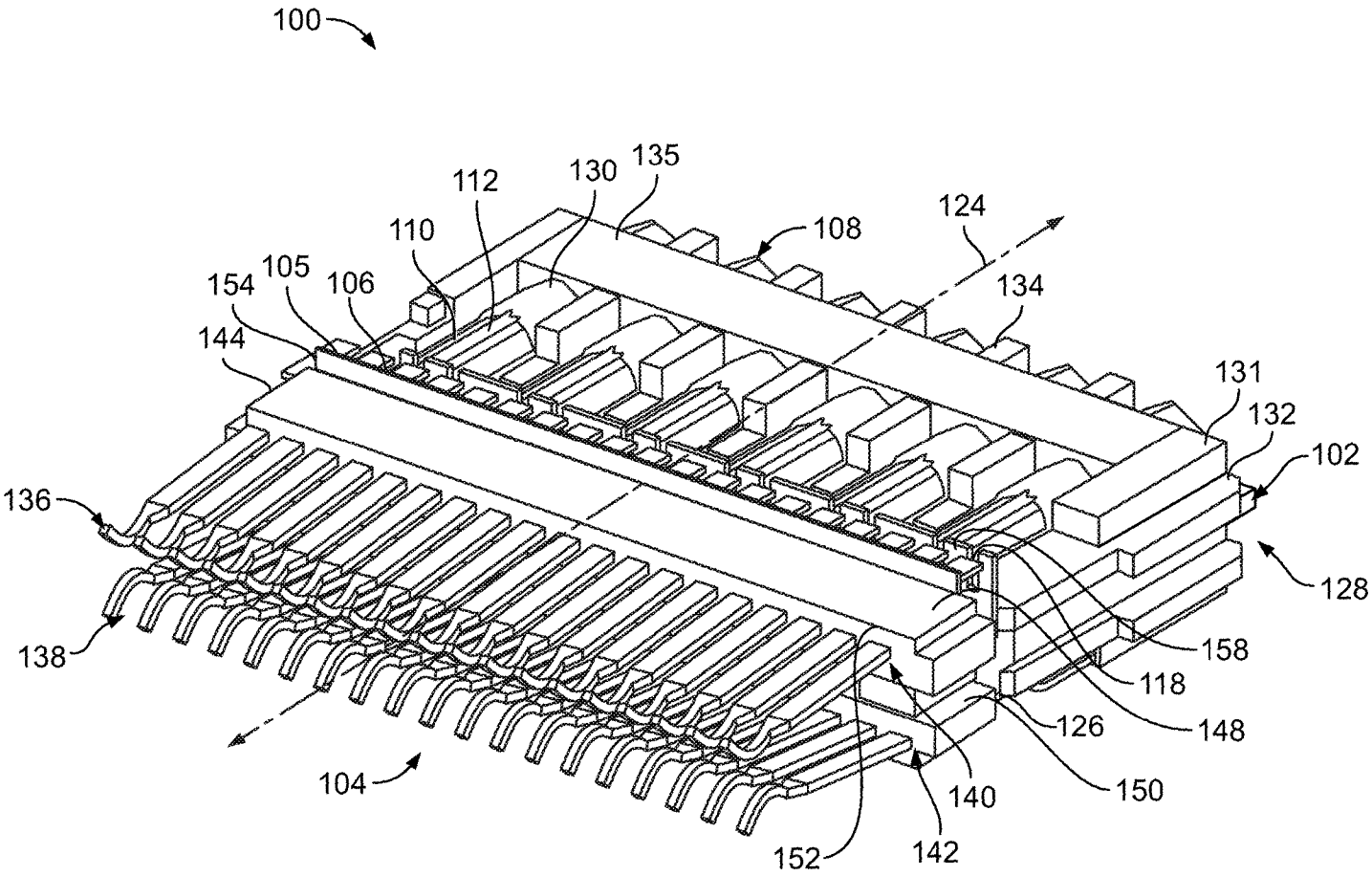
FIG. 2 is a perspective view of an electrical assembly according to one embodiment.

FIG. 2 is a perspective view of the electrical assembly 100 formed in accordance with one embodiment. In an exemplary embodiment, the electrical assembly 100 includes one or more electrical connectors 104 having one or more substrates 102. Each substrate 102 includes or supports a plurality of ground contacts 105 and a plurality of signal contacts 106. The electrical assembly 100 includes a plurality of communication cables 108 attached to the electrical connector 104. The communication cables 108 include signal conductors 110 and a drain wire 112 electrically connected to signal contacts 106 and ground contacts 105, respectively. The signal conductors 110 and the signal contacts 106 may be arranged in differential pairs configured to carry differential signals and being separated by shielding, such as the ground contacts 105.

Figure 3:
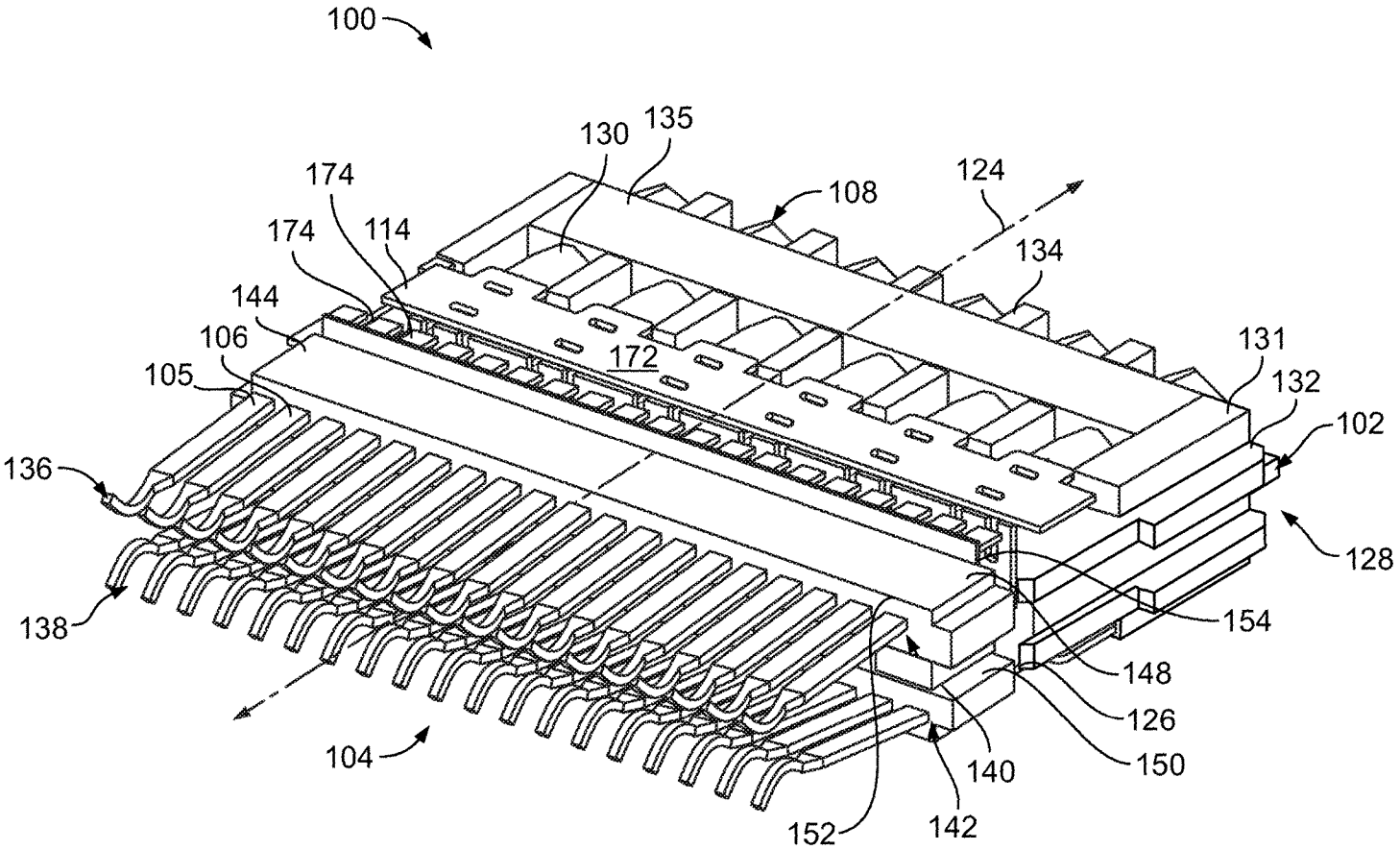
FIG. 3 is a perspective view of the electrical assembly of FIG. 2 with a ground bus bar according to one embodiment.

FIG. 3 is a perspective view of the electrical assembly 100 with a ground bus bar 114. In an exemplary embodiment, the contacts 105, 106 and the communication cables 108 may be provided on upper and lower sides of the substrate 102. Optionally, upper and lower ground bus bars 114 are used to electrically couple the ground contacts 105 to the drain wires 112 of the communication cables 108 although only the upper ground bus bar is fully shown in FIG. 3. Each ground bus bar 114 may be a single continuous piece of material. For example, each ground bus bar 114 may be stamped and formed from sheet metal or may be molded or cast using a conductive material.

Each ground bus bar 114 is configured to ground the communication cables 108 to the connector 104, such as to the ground contacts 105. Each ground bus bar 114 includes a main panel 172 mechanically and electrically coupled to the corresponding drain wires 112 and/or the shield layers 118 (shown in FIG. 4). Each ground bus bar 114 includes connective terminals 174 configured to be mechanically and electrically coupled to ground contacts 105. The mechanical and electrical coupling may be accomplished through physical contact, such as through interference contact and/or using soldering, conductive epoxy or foam or other conductive substance. As such, the communication cable 108 may be grounded to the connector 104 by establishing a conductive path between the shield layers 118, the drain wires 112, and the ground contacts 105.

The signal conductors 110 electrically couple with the signal contacts 106 of the connector 104. In other alternative embodiments, such as the exemplary embodiment shown in FIG. 7 which is described in detail below, the electrical connector 104 may define a circuit card connector, such as a paddle card, where the substrate 102 is a printed circuit board and the contacts 105, 106 are circuit pads proximate to an edge of the electrical connector 104. The electrical assembly 100 may include a connector housing (not shown) surrounding portions of the electrical connector 104.

Referring back to FIGS. 2 and 3, in an exemplary embodiment, an insulator wafer 116 is interposed between the communication cables 108 and the signal contacts 106 of the connector 104 to physically block and provide electrical isolation between the shield layers 118 of the communication cables 108 and the signal contacts 106 of the connector 104. Additionally, the insulator wafer 116 physically blocks and provides electrical isolation between the shield layer 118 and the signal conductor 110 of each communication cable 108.

The electrical assembly 100 has a connector portion 126, and a cable portion 128, that lie along a central axis 124. The electrical assembly 100 may be mated along the central axis 124. The connector portion 126 is proximate the mating end 20 of the housing 26 and the cable portion 128 is proximate the cable end 22 of the housing 26. The connector portion 126 is configured to receive a plug connector (not shown) of a communication system (not shown), such as a circuit card. The communication cables 108 extend from the cable portion 128 of the electrical assembly 100 enclosed by the insulative jacket to form the cable 28. Optionally, the substrate 102 may support portions of the communication cables 108. For example, the substrate 102 may include cable channels 134 that receive and position the communication cables 108.

Figure 4:
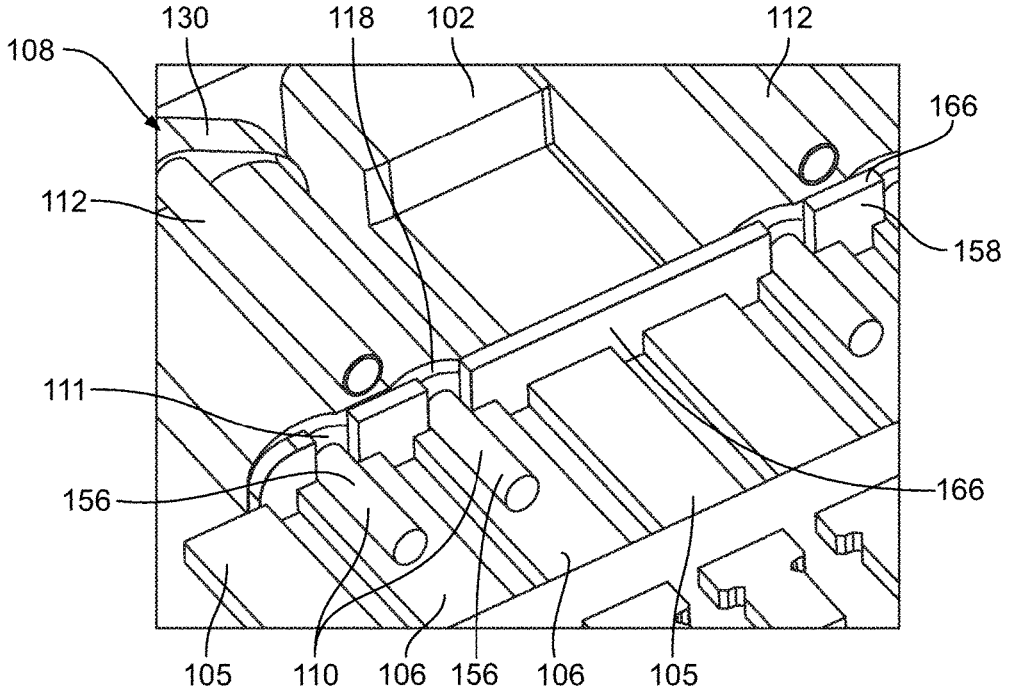
FIG. 4 is an enlarged perspective view of the electrical assembly of FIG. 2 according to one embodiment.

Each communication cable 108, as shown in FIG. 4, has an insulative jacket 130 surrounding a core. The insulative jacket 130 surrounds the one or more differential pairs of signal conductors 110 and the drain wire 112. The insulative jacket 130 may comprise a number of layers that surround the differential pairs for providing strain resistance for the communication cable 108 and environmental protection for the communication cable 108.

The substrate 102 includes upper surface 131 and lower surface 132 that face in opposite directions, although only the upper surface 131 is fully shown in FIG. 2. The cable portion 128 of each of the surfaces 131, 132, which is proximate the cable end 22 of the electrical device 10, defines channels 134 that are configured to receive the communication cables 108. Optionally, the communication cables 108 may be secured in the channels 134 in any suitable manner, such as an overmold 135. However, other methods can be used including but not limited to, bonding, adhesive, a retaining member, a mechanical interference fit, and the like. The connector portion 126 of each of the surfaces 131, 132, which is proximate the mating end 20 of the electrical device 10, is configured to couple with the connector 104. The connector 104 may couple with the connector portion 126 in any suitable manner, including but not limited to, bonding, overmolding, adhesive, welding, and the like.

In an exemplary embodiment, the substrate 102 is formed of a dielectric material, such as a plastic or one or more other polymers. However, portions of the substrate 102 may be conductive in alternative embodiments, such as to provide electrical shielding or grounding. In other various embodiments, the substrate 102 may be a printed circuit board (not shown) including upper and lower conductive traces, vias and the like defining the ground and signal contacts 105, 106.

In the illustrated embodiment, the electrical assembly 100 includes one electrical connector 104 coupled with the substrate 102. However, alternate embodiments could include any number of connectors. Each electrical connector 104 is a receptacle connector configured to electrically connect to a plug connector (not shown) in order to provide an electrically conductive signal path between the communication cables 108 and the plug connector. Each receptacle connector 104 may be a high-speed connector that transmits data signals at speeds over 10 gigabits per second (Gbps), such as over 25 Gbps. The receptacle connector 104 may also be configured to transmit low speed data signals and/or power. The receptacle connector 104 optionally may be an input-output (I/O) connector.

In an exemplary embodiment, the receptacle connector 104 includes upper and lower contact assemblies 140, 142 that attach to the respective connector portion 126 of the upper and lower surfaces 131, 132 of the substrate 102. The signal contacts 106 are distributed in upper and lower arrays 136, 138. For example, the upper array 136 is provided in the upper contact assembly 140 and the lower array 138 is provided in the lower contact assembly 142. Each contact assembly 140, 142 includes a dielectric carrier 144 holding the ground contacts 105 and the signal contacts 106. Mating ends of the signal contacts 106 in the upper array 136 are arranged side-by-side in an upper row and mating ends of the signal contacts 106 in the lower array 138 are arranged side-by-side in a lower row. The upper and lower rows 136, 138 extend parallel to each other and define a card slot for receiving a circuit card. The arrays 136, 138 may have other arrangements in alternative embodiments to define a different style of electrical assembly 100 having a different mating interface.

The signal contacts 106 are composed of an electrically conductive material, such as one or more metals. The signal contacts 106 may be stamped and formed into shape from a flat metal. In an embodiment, at least some of the signal contacts 106 of the receptacle connector 104 are used to convey high-speed data signals and some other signal contacts 106 are used to convey low-speed data signals. The ground contacts 105 are interspersed between corresponding signal contacts 106 to provide electrical shielding for the high-speed signals and/or the low-speed signals. For example, the arrays 136, 138 may arrange the signal contacts 106 in a ground-signal-signal-ground contact arrangement to provide electrical shielding between pairs of the signal contacts 106.

Optionally, the signal contacts 106 in each array 136, 138 may be evenly spaced-apart. As indicated above, the signal contacts 106 are held in place by the dielectric carrier 144. The dielectric carrier 144 extends between a top 148 and bottom 150. The contacts 105, 106 extend through the dielectric carrier 144 such that the mating ends protrude from a front 152 of the dielectric carrier 144 and the terminating ends protrude from the rear 154 of the dielectric carrier 144. The dielectric carrier 144 engages and holds an intermediate section (not shown) of the signal contacts 106 to retain the relative positioning and orientations of the signal contacts 106.

The dielectric carrier 144 is formed of a dielectric material, such as plastic or one or more other polymers. Optionally, the dielectric carrier 144 may be overmolded around the signal contacts 106. For example, the dielectric carrier 144 may include an overmolded body molded around the intermediate sections (not shown) of the signal contacts 106. The overmolded body may be injection molded around the signal contacts 106, which may be held together as part of a leadframe prior to overmolding. Alternatively, the signal contacts 106 may be loaded or stitched into a pre-formed dielectric carrier 144.

In the illustrated embodiment, the electrical assembly 100 includes six communication cables 108 coupled along the upper substrate surface 131 and six communication cables coupled along the lower substrate surface 132; however, any number of communication cables 108 may be used. In some embodiments, the communication cables 108 may be characterized as twin-axial or parallel-pair cables that includes a drain wire 112. In parallel-pair configurations, the communication cables 108 include differential pairs of signal conductors in which the two signal conductors of a single differential pair extend parallel to each other through a length of the communication cable 108. The drain wire 112 also extends in parallel with the signal conductors through the length of the communication cable 108. Although not shown, the communication cables 108 may be part of a larger cable and may be surrounded by an external jacket or sleeve. The external jacket may be stripped to permit manipulation of the communication cables 108 as set forth herein. In alternative embodiments, the signal conductors within the communication cable 108 may form a twisted pair of signal conductors. In other various embodiments, the communication cable 108 may be a single-ended cable having a single central conductor rather than the pair of signal conductors.

FIG. 4 is enlarged perspective view of the electrical assembly 100. Each of the communication cables 108 may include the differential pair of signal conductors 110, insulators 111 surrounding the signal conductors 110, the shield layer 118 that surrounds the insulators 111 and the signal conductors 110, the drain wire 112 and the insulative jacket 130 that surrounds the drain wire 112 and shield layer 118.

The communication cables 108 have had the insulators 111 stripped therefrom to expose the signal conductors 110. The exposed portions of the signal conductors 110 are configured to be terminated to the signal contacts 106 of the connector 104. The exposed portions of the signal conductors 110 are wire-terminating ends 156. The communication cables 108 are electrically connected to the signal contacts 106. For example, the wire-terminating ends 156 of the signal conductors 110 may be soldered to the signal contacts 106; however, the wire terminating ends 156 may be electrically connected by other means, such as crimping, welding, using conductive adhesive, using insulation displacement contacts, and the like. In an exemplary embodiment, the wire-terminating ends 156 pass through the insulator wafer 116 to connect to the signal contacts 106. The insulator wafer 116 electrically isolates the shield layer 118 from the signal conductor 110 and the signal contact 106. For example, the insulator wafer 116 may physically block the shield layer 118 from touching signal conductors 110 and the signal contacts 106. The insulator wafer 116 may pressingly seat against the shield layer 118 and the insulator 111 to separate the shield layer 118 from the signal contacts 106.

Optionally, the communication cables 108 may have the insulative jacket 130 stripped therefrom to expose the shield layer 118 and the drain wire 112. The exposed portions of the shield layer 118 and the drain wire 112 are configured to be terminated to the ground bus bars 114 (shown in FIG. 3). The communication cables 108 are configured to be electrically connected to the ground contacts 105 using the ground bus bars 114.

Figure 5:
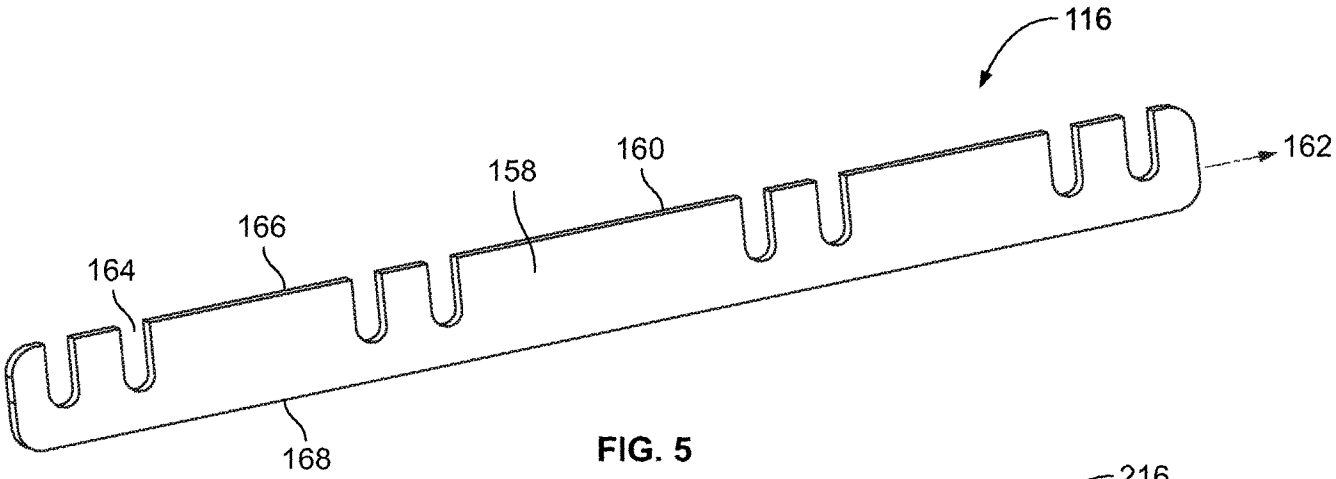
FIG. 5 is a perspective view of an insulator wafer according to one embodiment that may be used with the electrical device of FIG. 2.

With additional reference to FIG. 2, FIG. 5 is a perspective view of an insulator wafer 116 according to an exemplary embodiment. The insulator wafer 116 is manufactured from a dielectric material, such as a polymer material. The insulator wafer 116 includes a dielectric body having a front surface 158 and a rear surface 160. Optionally, the insulator wafer 116 may be generally planar extending along a wafer plane 162. The front and rear surfaces 158, 160 may be generally parallel to the wafer plane 162.

In an exemplary embodiment, the insulator wafer 116 includes generally U-shaped openings or slots 164 that extend from an upper edge 166 towards a lower edge 168, such as to the midpoint of the insulator wafer 116. The slots 164 are sized to receive corresponding signal conductors 110. The slots 164 are positioned to align the signal conductors 110 with the signal contacts 106. For example, the slots 164 may be arranged in pairs to receive the pairs of signal conductors 110 with the pairs of slots 164 being spaced apart to allow positioning of the ground contacts 105 between the signal contacts 106.

When the electrical assembly 100 is assembled, the insulator wafer 116 is interposed between the shield layers 118 of the communication cables 108 and the signal contacts 106 of the connector 104. The front surface 158 of the insulator wafer 116 pressingly seats against the signal contacts 106 and/or the substrate 102. For example, the substrate 102 may include a shoulder, lip, groove, or other structure to locate the insulator wafer 116, such as immediately behind the signal contacts 106. The rear surface 160 of the insulator wafer 116 pressingly seats against terminating ends of the shield layer 118 and terminating ends of the insulators 111. For example, the communication cables 108 may press against the rear surface 160 of the insulator wafer 116 when loaded into the substrate 102. The insulator wafer 116 physically blocks the shield layer 118 from contacting or touching the signal conductor 110 and the signal contact 106.

Optionally, the thickness of the insulator wafer 116 may control an impedance profile of the electrical assembly 100 in the gap between the terminating ends of the shield layers 118 and the signal contacts 106. As illustrated in FIG. 5, the insulator wafer has a thickness of about 0.08 mm to about 0.13 mm. However, alternate embodiments may include other thicknesses of the insulator wafer.

Figure 6:
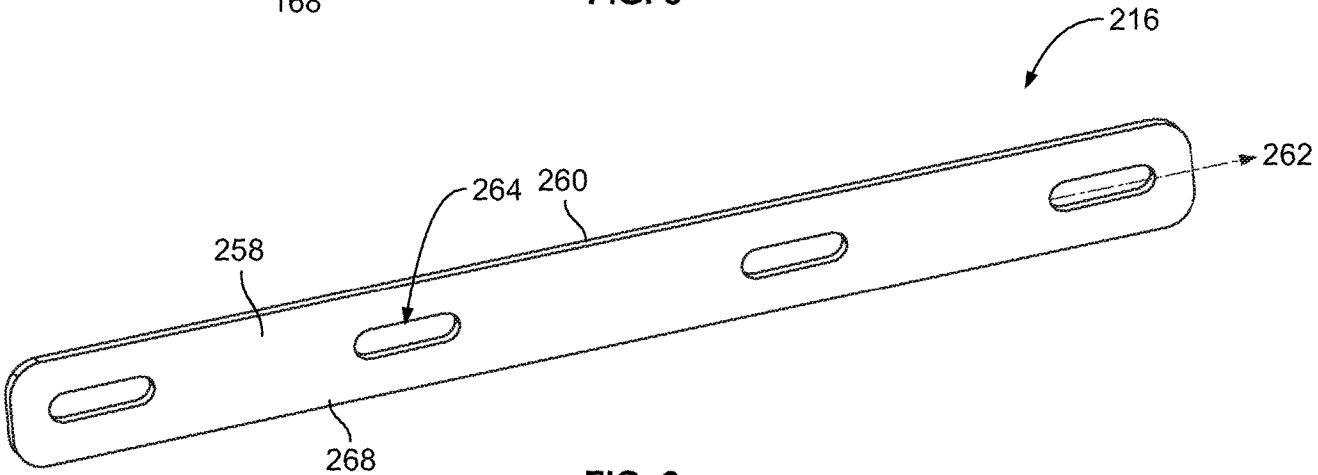
FIG. 6 is a perspective view of an insulator wafer according to another embodiment that may be used with the electrical device of FIG. 2.

FIG. 6 is a perspective view of an insulator wafer 216 according to an exemplary embodiment. The insulator wafer 216 is similar to the insulator wafer 116 (shown in FIG. 5); however, the insulator wafer 216 has openings or slots 264 that are shaped differently than the slots 164 in the insulator wafer 116. With additional reference to FIG. 4 to illustrate other components of the electrical assembly 100 such as the communication cables 108 and the substrate 102, it is evident that the insulator wafer 216 may be used in place of the insulator wafer 116.

The insulator wafer 216 includes a dielectric body extending between a front surface 258 and a rear surface 260 along a wafer plane 262. The insulator wafer 216 includes enclosed openings or slots 264. In the illustrated embodiment, the slots 264 are oblong and configured to receive two signal conductors 110; however, the slots 264 may have other shapes in alternative embodiments, such as circular slots configured to receive single signal conductors 110.

The insulator wafer 216 is configured to be interposed between the shield layers 118 of the communication cables 108 and the signal contacts 106 of the connector 104. The slots 164 are configured to align with and to receive the signal conductors 110 therethrough. The front surface 258 of the insulator wafer 216 pressingly seats against the signal contacts 106 and/or the substrate 102, and the rear surface 260 of the insulator wafer 216 pressingly seats against the terminating ends of the shield layer 118 and/or the terminating ends of the insulators 111. The insulator wafer 216 physically blocks the shield layers 118 from contacting or touching the signal conductors 110 and the signal contacts 106. Optionally, the thickness of the insulator wafer 116 may control an impedance profile of the electrical assembly 100 in the gap between the terminating ends of the shield layers 118 and the signal contacts 106.

Figure 7:
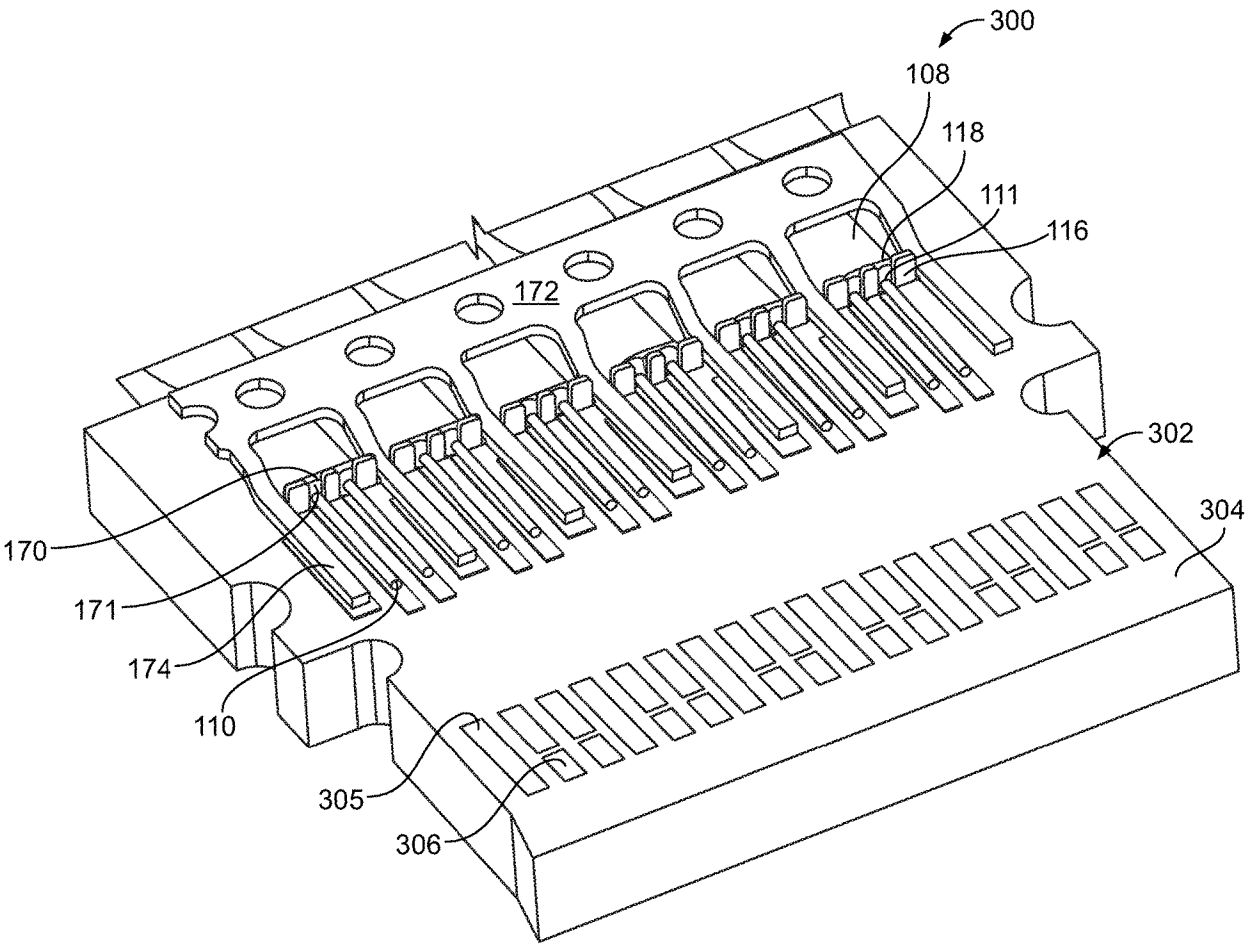
FIG. 7 is a perspective view of a portion of an electrical device according to an exemplary embodiment.

FIG. 7 is a perspective view of a portion of an electrical device 300 according to an exemplary embodiment. The electrical device 300 is similar to the electrical assembly 100 (shown in FIG. 2); however, the electrical device 300 includes a substrate 302 defined by a circuit board 304. The circuit board 304 includes ground contacts 305 and signal contacts 306 defined by conductive traces, vias or other circuits printed on the circuit board 304. The communication cables 108 are electrically connected to the ground contacts 305 and the signal contacts 306, such as by soldering. The insulator wafer 116 is positioned at terminating ends 170, 171 of the shield layers 118 and the insulators 111. The insulator wafer 116 is positioned between the shield layers 118 and the signal contacts 306. The insulator wafer 116 electrically isolates the shield layers 118 from the signal conductors 110 and the signal contacts 306, such as by physically blocking the shield layers 118 from the signal conductors 110 and the signal contacts 306.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical device comprising:

a substrate having a signal contact and a ground contact along a surface of the substrate;

an insulator wafer having a front surface, a rear surface, and an opening, the front surface facing the signal contact, the insulator wafer also having an upper edge and a lower edge, wherein the insulator wafer is disposed inside the electrical device between the substrate and a ground bus bar; and a communication cable including a signal conductor, an insulator surrounding the signal conductor, and a shield layer that surrounds the insulator, wherein the upper edge of the insulator wafer is substantially planar with the shield layer of the communication cable; wherein the insulator has a terminating end and the shield layer has a terminating end substantially coplanar with the terminating end of the insulator, a terminating end of the signal conductor extending beyond the terminating end of the insulator; wherein the terminating end of the signal conductor projects through the opening of the insulator wafer to electrically couple with the signal contact, the insulator wafer electrically isolating the shield layer from the signal contact;

wherein the front surface of the insulator wafer pressingly seats against the signal contact.

2. The electrical device of claim 1, wherein the insulator wafer physically blocks the shield layer from touching the signal conductor and the signal contact.

3. The electrical device of claim 1, wherein the insulator wafer has a predetermined thickness to control an impedance profile of the electrical device in a gap between the terminating end of the shield layer and the ground contact.

4. The electrical device of claim 1, wherein the rear surface of the insulator wafer pressingly seats against at least one of the terminating ends of the shield layer and the insulator.

5. The electrical device of claim 1, wherein the opening of the insulator wafer is a generally U-shaped slot extending inwardly from an edge of the insulator wafer to receive the signal conductor from the edge of the insulator wafer.

6. The electrical device of claim 1, wherein the opening of the insulator wafer is an enclosed slot, the opening being in alignment with the signal conductor to receive the signal conductor through the slot.

7. The electrical device of claim 1, wherein the insulator wafer extends along a wafer plane perpendicular to the surface of the substrate.

8. The electrical device of claim 1, wherein the opening of the insulator wafer is aligned with the signal contact.

9. The electrical device of claim 1, wherein the communication cable has a drain wire electrically coupled with the shield layer, the drain wire being electrically connected to the ground contact.

10. The electrical device of claim 1, wherein the substrate is a printed substrate.

11. The electrical device of claim 9, wherein the ground bus bar is electrically coupled to the ground contact, the ground bus bar having a main panel laying across the communication cable and a connective terminal extending from the main panel being electrically coupled to the drain wire.

12. The electrical device of claim 1, wherein the communication cable comprises a second signal conductor, a second insulator surrounding the second signal conductor, and a second shield layer that surrounds the second insulator; wherein the second insulator and the second shield layer have substantially coplanar terminating ends, a terminating end of the second signal conductor extends beyond the terminating end of the second insulator; wherein the terminating end of the second signal conductor projects through a corresponding opening of the insulator wafer to electrically couple with a second signal contact of the substrate, the insulator wafer electrically isolating the second shield layer from the second signal conductor and the second signal contact.

13. The electrical device of claim 1, further comprising a second communication cable comprising a second signal conductor, a second insulator surrounding the second signal conductor, and a second shield layer that surrounds the second insulator; wherein the second insulator and the second shield layer have substantially coplanar terminating ends, a terminating end of the second signal conductor extends beyond the terminating end of the second insulator; wherein the terminating end of the second signal conductor projects through a corresponding opening of the insulator wafer to electrically couple with the second signal contact, the insulator wafer electrically isolating the second shield layer from the second signal conductor and the second signal contact.

14. An electrical device, comprising:

a substrate having an upper signal contact and an upper ground contact along an upper surface of the substrate and a lower signal contact and a lower ground contact along a lower surface of the substrate;

an upper insulator wafer having a front surface, a rear surface, and an opening, the front surface facing the upper signal contact on the upper surface of the substrate;

an upper communication cable including a signal conductor, an insulator surrounding the signal conductor, and a shield layer that surrounds the insulator; wherein the insulator and the shield layer have substantially coplanar terminating ends, and a terminating end of the signal conductor extends beyond a terminating end of the insulator; wherein the terminating end of the signal conductor projects through the opening of the upper insulator wafer to electrically couple with the upper signal contact, the upper insulator wafer electrically isolating the shield layer from the upper signal contact, wherein the front surface of the upper insulator wafer pressingly seats against the upper signal contact;

a lower insulator wafer having a front surface, a rear surface, and an opening, the front surface facing the lower signal contact on the lower surface of the substrate;

a lower communication cable including a signal conductor, an insulator surrounding the signal conductor, and a shield layer that surrounds the insulator; wherein the insulator and the shield layer have substantially coplanar terminating ends, and a terminating end of the signal conductor extends beyond a terminating end of the insulator; wherein the terminating end of the signal conductor projects through the opening of the lower insulator wafer to electrically couple with the lower signal contact, the lower insulator wafer electrically isolating the shield layer from the lower signal contact, wherein the front surface of the lower insulator wafer pressingly seats against the lower signal contact.

15. The electrical device of claim 14, wherein the upper insulator wafer physically blocks the shield layer from touching the upper signal conductor and the upper signal contact.

16. The electrical device of claim 14, wherein the upper insulator wafer has a predetermined thickness to control to an impedance profile of the electrical device in a gap between the terminating end of the shield layer and the upper ground contact.

17. An electrical device comprising:

a substrate having signal contacts and ground contacts along a surface of the substrate;

a plurality of communication cables, each communication cable including a signal conductor, an insulator surrounding the signal conductor, and a shield layer that surrounds the insulator; wherein the insulator has a terminating end and the shield layer has a terminating end substantially coplanar with the terminating end of the insulator, a terminating end of the signal conductor extending beyond the terminating end of the insulator, wherein at least one of the communication cables including a drain wire electrically coupled with the shield layer, the drain wire being electrically coupled to at least one of the ground contacts;

an insulator wafer having a front surface, a rear surface, and a plurality of openings, the insulator wafer being interposed between the terminating ends of the communication cable and the signal contacts; and a ground bus bar electrically coupled to the ground contacts, the ground bus bar having a main panel laying across the communication cable and a connective terminal extending from the main panel being electrically coupled to the drain wire, wherein the insulator wafer is disposed between the substrate and the ground bus bar, wherein the terminating ends of the signal conductors project through corresponding openings of the insulator wafer to electrically couple with corresponding signal contacts, the insulator wafer electrically isolating the shield layers from the signal contacts;

wherein the front surface of the insulator wafer faces the signal contacts, and the rear surface of the insulator wafer faces the shield layers of the communication cables, the signal conductors projecting through the corresponding openings of the insulator wafer to electrically couple with the signal contacts; and wherein the front surface of the insulator wafer pressingly seats against the signal contacts.

18. The electrical device of claim 17, wherein the insulator wafer physically blocks the shield layers from the signal conductors and the signal contacts.

19. The electrical device of claim 17, wherein the openings of the insulator wafer are spaced apart to control positions of the terminating ends of the signal conductors to align the signal conductors with the signal contacts.

* * * * *